United States Patent [19]

Simpson et al.

[11] Patent Number: 5,013,622

[45] Date of Patent: May 7, 1991

[54] SUPERSENSITIZATION OF SILVER HALIDE EMULSIONS

[75] Inventors: Sharon M. Simpson, Lake Elmo; John R. Boon, Woodbury, both of Minn.

[73] Assignee: Minnesota Mining and Manufacturing Company, St. Paul, Minn.

[21] Appl. No.: 941,287

[22] Filed: Dec. 12, 1986

[51] Int. Cl.[5] ..... G03C 1/28

[52] U.S. Cl. ..... 430/550; 430/572; 430/575; 430/611

[58] Field of Search ..... 430/572–577, 430/566, 612, 634, 550, 611, 614

[56] References Cited

U.S. PATENT DOCUMENTS

| | | | |
|---|---|---|---|
| 2,288,226 | 6/1942 | Carroll et al. | 430/572 |
| 3,458,316 | 7/1969 | Viro | 96/94 |
| 3,481,742 | 12/1969 | Terashima et al. | 430/572 |
| 4,318,979 | 3/1982 | Habu et al. | 430/612 |
| 4,603,104 | 7/1986 | Philip | 430/572 |
| 4,619,892 | 10/1986 | Simpson et al. | 430/505 |

FOREIGN PATENT DOCUMENTS

| | | |
|---|---|---|
| 0123983 | 4/1984 | European Pat. Off. . |
| 691715 | 5/1953 | United Kingdom . |
| 1221137 | 2/1971 | United Kingdom . |
| 1221138 | 2/1971 | United Kingdom . |

*Primary Examiner*—Charles L. Bowers, Jr.
*Assistant Examiner*—Mark R. Buscher
*Attorney, Agent, or Firm*—Gary L. Griswold; Walter N. Kirn; Mark A. Litman

[57] ABSTRACT

Supersensitization of silver halide emulsions is effected by the addition of a metal chelating agent after chemical sensitization or a combination of phenylmercaptotetrazoles and a metal chelating agent to a spectrally sensitized emulsion. The contrast of the emulsion may also be increased by the addition of this combination of materials after chemical and spectral sensitization.

15 Claims, No Drawings

SUPERSENSITIZATION OF SILVER HALIDE EMULSIONS

BACKGROUND OF THE INVENTION

The phenomenon of supersensitization is well known to those skilled in the photographic art. Supersensitization is not limited to the effect of multiple sensitizing dyes themselves but also includes compounds which increase the speed of an emulsion after dye sensitization. These additives supersensitize the dye sensitizer even when the additive compound itself does not sensitize the silver halide in the spectral region in which the sensitizer is active. Upon addition of the compound, the spectral sensitivity of the dye is increased. The supersensitizer may be either increasing the absorption of light by the dye (intensifying the J-Band) or increasing the adsorption of the dye to the silver halide grain surface. These theories are described in the art (e.g., James, T. H., *The Theory of the Photographic Process* p. 259–261, Macmillan Publishing (N.Y. 1977), Sturge, J. M., *Neblette's Handbook of Photography and Reprography,* p. 92–96, Litton Education Publishing (N.Y. 1977).

Triphenylphosphine, stilbene-like moieties such as bis(triazine-2-ylamino) stilbene benzothiazole or benzoxazole type compounds, as described in U.S. Pat. No. 4,603,104 and European Patent No. 123,983 have been added to dye sensitized emulsions as speed enhancers.

Ethylenediaminetetraacetic acid (EDTA), diethylenetriaminepentaacetic acid (DTPA) and other amine-type acetic acid compounds are not known as supersensitizers but are well known in the photographic art as chelating agents used in developer solutions during processing. This use is described in the art (e.g., U.S. Pat. No. 4,588,677).

Great Britain Patent 1,221,137 describes the use of DTPA, EDTA and other amine-type acetic acid compounds to improve emulsion sensitivity. These compounds are added during the formation of silver halide grains (precipitation) and excess compound is removed during the washing process. The patent further states that no speed enhancement is observed if the chelating agents are added after sulfur (chemical) sensitization rather than during the precipitation step.

In connection with this patent, Great Britain Patent 1,221,138 describes reducing metal spots on coated emulsion layers by the addition of these chelating agents after chemical sensitization. This invention only describes the prevention of metal spots and does not report an increase in emulsion sensitivity.

The use of mercaptotetrazoles as supersensitizers in combination with certain cyanine dyes, hydroquinones, bis(triazine-2-ylamino) stilbenes, and poly(ethylacrylate) has been described in U.S. Pat. Nos. 2,403,977; 3,266,897; 3,397,987; 3,457,078; 3,637,393 and 4,603,104.

U.K. Patent No. 691,715 discloses the improvement of light-sensitivity of colloid-silver halide emulsions by the addition of ethylenediamine tetraacetic acid (or its salts and esters) prior to the end of the emulsion digestion period for silver halide emulsions. Only small amounts are used, with a range of 0.097% to 0.91% by weight of amine to silver disclosed.

U.S. Pat. No. 3,458,316 discloses the improvement of light-sensitivity of silver halide gelatin emulsions by the addition of nitrilotriacetic acid and its water-soluble salts to emulsions prior to the precipitation of silver halide grains therein.

SUMMARY OF THE INVENTION

The addition of at least 1% by weight of silver of a metal complexing agent to a silver halide emulsion after chemical sensitization of the emulsion, alone or in combination with a phenylmercaptotetrazole and spectral sensitizing dye, increases the speed of the emulsion generally beyond the additive speed of the individual ingredients. The combination of these ingredients also can increase the contrast of the emulsion. Preferred complexing agents include nitrilotriacetic acid, ethylenediaminetetraacetic acid (and its alkali metal salts), and diethylenetriaminepentaacetic acid (and its alkali metal salts), triethylenetetraamine hexaacetic acid (and its alkali metal salts). The alkyl (e.g., 1 to 20 carbons, preferably 1 to 4 carbons) and aryl (e.g., 6 to 14 carbons, preferably phenyl) esters of these acids perform equally well in comparison to the acids and in some cases may be more stable. The complexing agents are preferably added after spectral sensitization of the emulsion. These emulsions have not been exposed to radiation and do not have a latent image therein.

DETAILED DESCRIPTION OF THE INVENTION

The combination of a spectral sensitizing dye and a metal complexing agent present in the emulsion after chemical sensitization or added after chemical sensitization, and optionally a phenylmercaptotetrazole, in a photographic emulsion provides an emulsion with improved speed. The supersensitization effect is at least additive and usually more than additive then the individual contributions of the components. As supersensitizers are not generally found to provide even additive effects, their final contributions usually being less than the sum of the individual contributors, the combinations of the present invention are highly desirable. This supersensitization effect has been found to be operative for spectral sensitizing dyes within both the visible and infrared regions of the electromagnetic spectrum.

The addition of chelating amine-type acetic acids or the addition of these compounds in combination with substituted mercaptotetrazoles particularly have been found to provide unique supersensitization effects on photographic silver halide emulsions. The addition also provides an additional benefit of improved contrast.

The amine-type acetic acids useful in the practice of the present invention are defined by the following formulae:

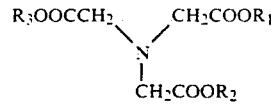

I

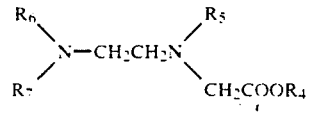

II

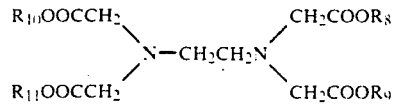

III

-continued

IV

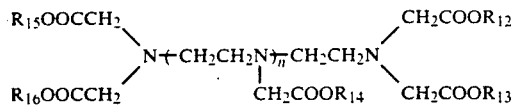

wherein $R_1$ through $R_4$, $R_8$ through $R_{16}$, which can be the same or different, each represents a hydrogen atom, an alkali metal atom, aryl (including aralkyl), or an alkyl group (including alkaryl), and $R_5$–$R_7$, which can be the same or different, each represents a hydrogen atom, an alkyl group or an acetic acid group as shown below $$-CH_2COOR_1$$

wherein $R_1$ is defined above, and n represents an integer of 1 or greater (preferably 1 to 4).

Specific examples of the amine-type acetic acids represented by the formulae I, II, III and IV are shown below which, however, do not limit the compounds to be used in the present invention.

$N(CH_2COONa)_3$ I-A $N(CH_2COOC_2H_5)_3$ I-B $(CH_2NHCH_2COOH)_2$ II-A

III-A

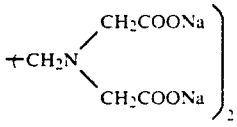

III-B

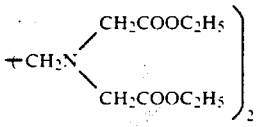

IV-A

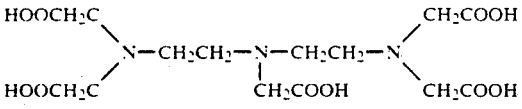

IV-B

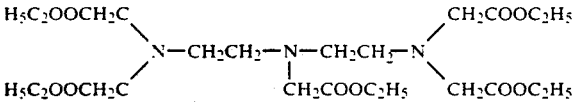

IV-C

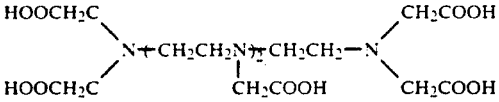

Many of these compounds shown are commercially available. Also, such compounds can be prepared by the methods described, for examples, by Mueller, W. H. *Archiv der Pharmazie* 307(5), p. 336–340, 1974. The complexing agents tend to have a pK (Ag) of between 4 and 10, preferably between 5 and 9 in a mildly acidic (pH 4 to 6) aqueous environment.

The substituted mercaptotetrazoles useful in the practice of the present invention are defined by the formula (V)

V

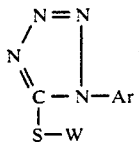

wherein Ar is a phenyl group which may or may not be substituted as with alkyl, alkoxy, fused benzyl (to form naphthyl or anthryl groups), halogen, amino, sulfonic acid or a carboxyl group as described in U.S. Pat. No. 3,457,018, and W is a hydrogen atom or may be a second mercaptotetrazole group with substituted Ar groups as described above.

Specific examples of the substituted mercaptotetrazole compounds represented by the formula (V) are shown below, although the compounds for use in this invention are not limited thereto.

V-A

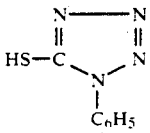

V-B

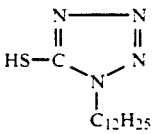

V-C

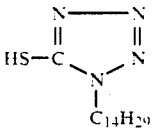

V-D

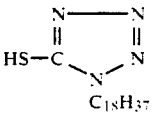

V-E

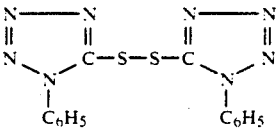

V-F

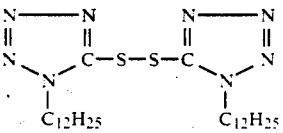

The sensitizing dyes may be any visible and any infrared spectral sensitizing dye with the preferred structures according to the present invention defined by the following formulae VI, VII and VIII

VI

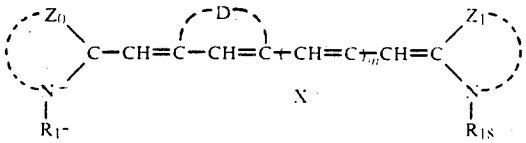

-continued

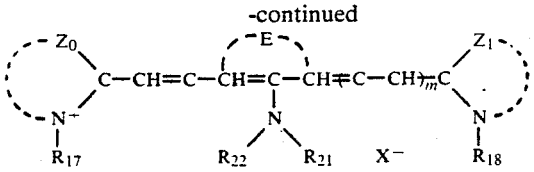

VII

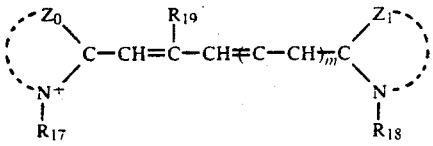

VIII wherein $R_{17}$ and $R_{18}$, which may be the same or different, each represents an alkyl group (preferably containing 1 to 8 carbon atoms, e.g., a methyl group, an ethyl group, a propyl group, a butyl group, a pentyl group, a heptyl group) or a substituted alkyl group preferably containing 6 or less carbon atoms (substituted by, for example, a carboxy group, a sulfo group, a cyano group, a halogen atom (e.g., a fluorine atom, a chlorine atom, a bromine atom), a hydroxy group, an alkoxycarbonyl group (containing 8 or less carbon atoms, e.g., a methoxycarbonyl group, an ethoxycarbonyl group, a benzyloxycarbonyl group), an alkoxy group (containing 7 or less carbon atoms, e.g., a methoxy group, an ethoxy group, a propoxy group, a butoxy group, a benzyloxy group), an aryloxy group (e.g., a phenoxy group, a p-tolyloxy group), an acyloxy group (containing 3 or less carbon atoms, e.g., an acetyloxy group, a propionyloxy group), an acyl group (containing 8 or less carbon atoms, e.g., an acetyl group, a propionyl group, a benzoyl group, a mesyl group), a carbamoyl group (e.g., a carbamoyl group, an N,N-dimethylcarbamoyl group, a morpholinocarbamoyl group, a piperidinocarbamoyl group), a sulfamoyl group (e.g., a sulfamoyl group, an N,N-dimethylsulfamoyl group, a morpholinosulfonyl group), an aryl group (e.g., a phenyl group, a p-hydroxyphenyl group, a p-carboxyphenyl group, a p-sulfophenyl group, an α-naphthyl group), or the like, provided that the alkyl group may be substituted by two or more of these substituents).

$R_{19}$ represents a hydrogen atom, a lower alkyl group containing 5 or less carbon atoms (e.g., a methyl group, an ethyl group, a propyl group), a phenyl group or a benzyl group, a halogen atom, a hydroxyl group, a carboxyl group or an acyloxy group shown below by

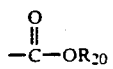

wherein $R_{20}$ represents an alkyl group having 1 to 5 carbon atoms, or an unsubstituted or substituted phenyl group.

D represents non-metallic atoms necessary for completing a 6-membered ring containing three methylene units, which ring may be substituted by a lower alkyl group containing 4 or less carbon atoms (e.g., a methyl group) or the like.

The following formula is a preferred example of the 6-membered ring formed with D and the three methylene units:

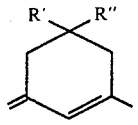

In the above formula, R' and R'' each represents a hydrogen atom, a lower alkyl group containing 8 or less carbon atoms such as for example, methyl, ethyl, propyl, butyl, amyl, benzyl, carboxyethyl, sulfopropyl, carboxypropyl, sulfobutyl groups, etc.

E represents the non-metallic atoms (preferably selected from C, N, S, O and Se) necessary for completing a 5-membered ring wherein $R_{21}$ and $R_{22}$, which can be the same or different, each represents a hydrogen atom, an alkyl group or a phenyl group.

$Z_0$ and $Z_1$ each represents non-metallic atoms necessary for completing a 5- or 6-membered, nitrogen-containing heterocyclic ring such as a thiazole nucleus (for example, benzothiazole, naphthothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, naphthol[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, a selenazole nucleus (for example, benzoselenazole, 5-chlorobenzoselenazole, 5-methoxybenzoselenazole, 5-methylbenzoselenazole, 5-hydroxybenzoselenazole, naphtho[2,1-d]selenazole, naphtho[1,2-d]selenazole), an oxazole nucleus (for example, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho[2,1-d]oxazole, naphtho[1,2-d]oxazole, naphtho[2,3-d]oxazole), a quinoline nucleus (for example, 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-4-quinoline), a 3,3-dialkylindolenine nucleus (for example, 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine), an imidazole nucleus (for example, 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-alkyl-6-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, 1-ethylnaphtho[1,2-d]imidazole), a pyridine nucleus (for example, pyridine, 5-methyl-2-pyridine, 3-methyl-4-pyridine) and a merocyanine nucleus.

X represents an acid anion, for example, a halide ion (e.g., $Cl^-$, $Br^-$ or $I^-$), perchlorate ion, sulfamate, thiocyanate ion, acetate ion, methylsulfate ion, ethylsulfate ion, benzenesulfonate ion, toluenesulfonate ion.

m represents 0, 1, 2 and 3. Sensitizing dyes represented by the general formula VI, VII and VIII are well known compounds and can be synthesized by the method described in U.S. Pat. No. 2,734,900 and are described for example in U.S. Pat. Nos. 3,457,078; 3,619,154; 3,682,630; 3,690,891; 3,695,888; 4,030,932 and 4,367,800.

Specific examples of the sensitizing dyes represented by the general formula VI, VII and VIII are illustrated below which, however, does not limit the dyes used in the present invention.

VIII-A

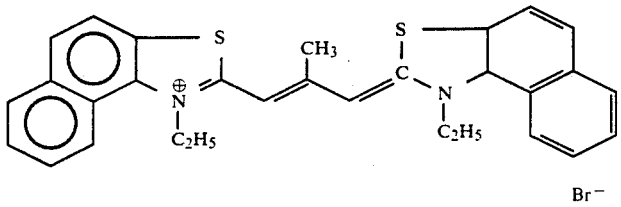

VIII-B

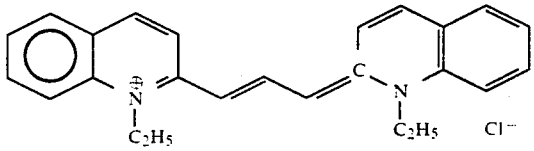

VIII-C

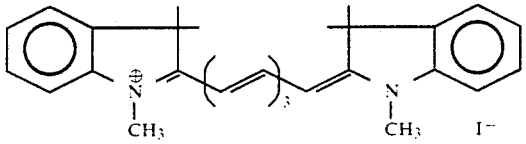

VIII-D

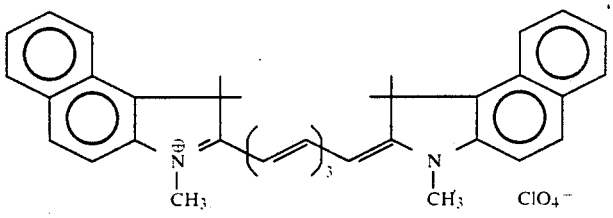

VIII-E

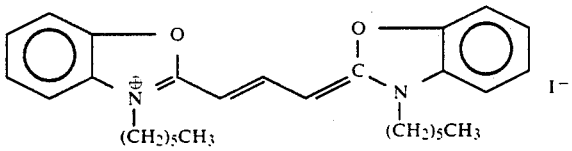

VIII-F

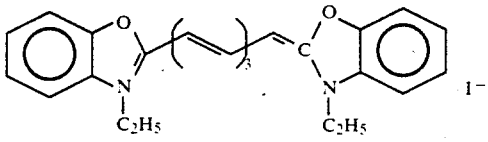

VIII-G

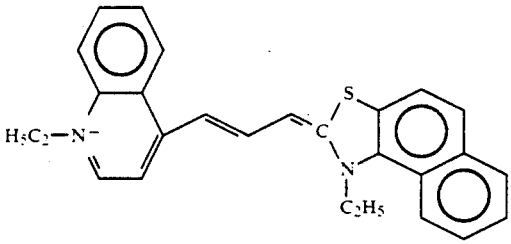

-continued
VIII-H
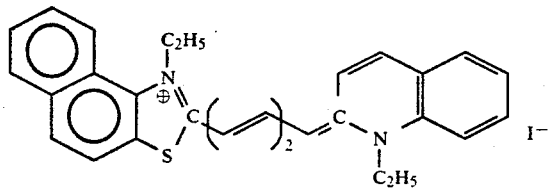
VIII-I
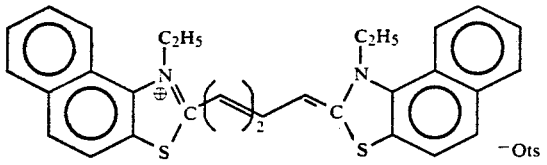
VI-A
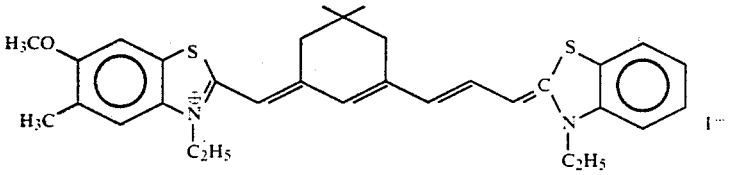
VI-B
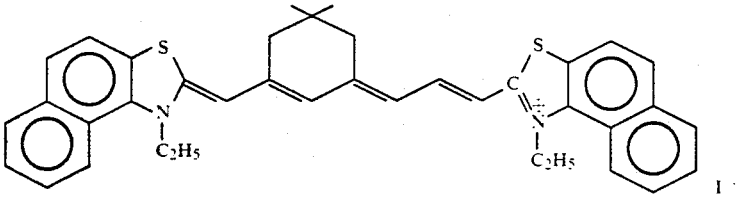
VI-C
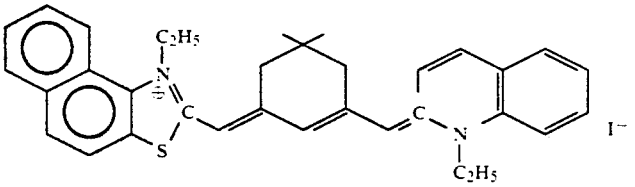
VI-D
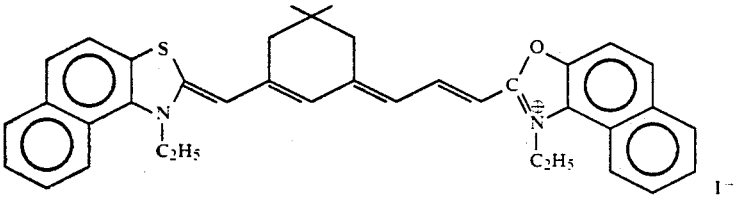
VII-A
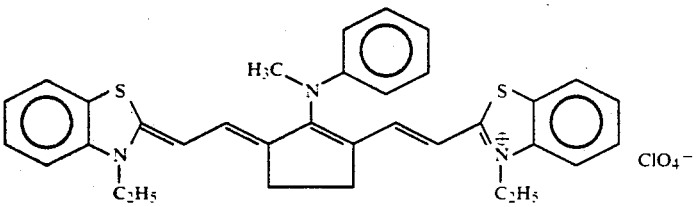

-continued

VII-B

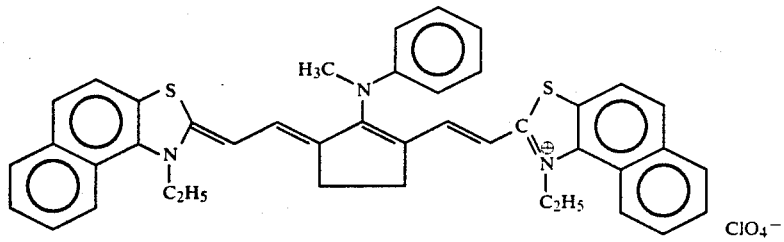

The amine-type acetic acid compound of formulae I, II, III or IV in the present invention are added to the emulsion mixture just prior to coating and after spectral sensitization with the sensitizing dye compounds of formulae VI, VII or VIII. These compounds are usually dissolved in a suitable solvent (for example, methanol, ethanol, water) or a mixture of solvents, and added as a solution to the emulsion. After addition, the mixture is stirred well and then coated onto the photographic substrate.

The compounds of formulae I, II, III or IV are added by weight preferably in the range of 1/1 to 1/1000 (dye/compound) and most preferably in the range of 1/20 to 1/500. The complexing agents are present in an amount equal to or greater than 1% by weight silver in the emulsion layer. Preferably the complexing agents are present as at least 2% by weight, preferably in a range of 2–35% by weight of silver in the emulsion layer, more preferably 3–32%, still more preferably as 5–20% and most preferably as 7–18% by weight of silver in the emulsion layer.

The substitutes mercaptotetrazole compounds of formulae V in the present invention are added and prepared in the same manner as described above. These compounds are added by weight preferably in the range of 1/20 to 100/1 (dye/compound) and most preferably in the range of 1/2 to 10/1. This range is about $1\times10^{-3}$% to 2% by weight of silver, preferably 0.01% to 0.2% by weight of silver.

The sensitizing dyes of the formulae VI, VII and VIII in the present invention are added to the silver halide emulsion in amounts of $5\times10^{-7}$ mole to $1\times10^{-2}$ mole, and most preferably in the amounts of $1\times10^{-6}$ to $1\times10^{-3}$ mole per mole of silver.

These sensitizing dyes are usually dissolved in a suitable solvent such as methanol, ethanol, methyl, cellusolve, acetone, water, pyridine, or a mixture thereof before adding them to the emulsion. Once added, the mixture is stirred well and the compounds of formula I, II, III, IV or V are added just prior to coating.

The concentration of dyes, amine-type acetic acid compounds, and the substituted mercaptotetrazole compounds will vary and supersensitizing effects will vary depending on the silver halide emulsion type.

Any of the various types of photographic silver halide emulsions may be used in the practice of the present invention. Silver chloride, silver bromide, silver iodobromide, silver chlorobromide, silver chlorobromide and mixtures thereof may be used for example. Any configuration of grains, cubic orthorhombic, hexagonal, epitaxial, lamellar, tabular or mixtures thereof may be used. These emulsions are prepared by any of the well-known procedures, e.g., single or double jet emulsions as described by Wietz et al., U.S. Pat. No. 2,222,264, Illingsworth, U.S. Pat. No. 3,320,069, McBride, U.S. Pat. No. 3,271,157 and U.S. Pat. Nos. 4,425,425 and 4,425,426.

The silver halide emulsions supersensitized with the dyes of this invention can be unwashed or washed to remove soluble salts. In the latter case the soluble salts can be removed by chill-setting and leaching or the emulsion can be coagulation washed e.g., by the procedures described in Hewitson et al., U.S. Pat. No. 2,618,556; Yutzy et al., U.S. Pat. No. 2,614,928; Yackel, U.S. Pat. No. 2,565,418; Hart et al., U.S. Pat. No. 3,241,969; and Waller et al., U.S. Pat. No. 2,489,341.

Photographic emulsions containing supersensitizing combinations in accordance with this invention can be sensitized with chemical sensitizers, such as with reducing agents; sulfur, selenium or tellurium compounds; gold, platinum or palladium compounds; or combinations of these. Suitable chemical sensitization procedures are described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

The supersensitized silver halide emulsions of this invention can contain speed increasing compounds such as polyalkylene glycols, cationic surface active agents and thioethers or combinations of these as described in Piper, U.S. Pat. No. 2,886,437; Chechak, U.S. Pat. No. 3,046,134; Carroll et al., U.S. Pat. No. 2,944,900; and Goffe, U.S. Pat. No. 3,294,540.

Silver halide emulsions containing the supersensitizing combinations of this invention can be protected against the production of fog and can be stabilized against loss of sensitivity during keeping. Suitable antifoggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Patent 623,448; nitron; nitroindazoles; the polyvalent metal salts described in Jones, U.S. Pat. No. 2,839,405; the thiuronium salts described in Herz, U.S. Pat. No. 3,220,839; and the palladium, platinum and gold salts described in Trivelli, U.S. Pat. No. 2,566,263 and Damschroder, U.S. Pat. No. 2,597,915.

Silver halide supersensitized in accordance with the invention can be dispersed in colloids that can be hardened by various organic or inorganic hardeners, alone or in combination, such as the aldehydes, and blocked aldehydes, ketones, carboxylic and carbonic acid derivatives, sulfonate esters, sulfonyl halides and vinyl sulfones, active halogen compounds, epoxy compounds, aziridines, active olefins, isocyanates, carbodiimides, mixed function hardeners and polymeric hardeners such as oxidized polysaccharides, e.g., dialdehyde starch, oxyguargum, etc.

Photographic emulsions supersensitized with the materials described herein can contain various colloids alone or in combination as vehicles or binding agents. Suitable hydrophilic materials include both naturally-occurring substances such as proteins, for example, gelatin, gelatin derivatives (e.g., phthalated gelatin), cellulose derivatives, polysaccharides such as dextran, gum arabic and the like; and synthetic polymeric substances such as water soluble polyvinyl compounds, e.g., poly(vinylpyrrolidone) acrylamide polymers or other synthetic polymeric compounds such as dispersed vinyl compounds in latex form, and particularly those which increase the dimensional stability of the photographic materials. Suitable synthetic polymers include those described, for example, in U.S. Pat. Nos. 3,142,568 of Nottorf; 3,193,386 of White; 3,062,674 of Houck, Smith and Yudelson; U.S. Pat. No. 3,220,844 of Houck, Smith and Yudelson; Ream and Fowler, U.S. Pat. No. 3,287,289; and Dykstra, U.S. Pat. No. 3,411,911; particularly effective are those water-insoluble polymers of alkyl acrylates and methacrylates, acrylic acid, sulfoalkyl acrylates or methacrylates, those which have cross linking sites which facilitate hardening or curing and those having recurring sulfobetaine units as described in Canadian Patent 774,054.

Emulsions supersensitized in accordance with this invention can be used in photographic elements which contain antistatic or conducting layers, such as layers that comprise soluble salts, e.g., chlorides, nitrates, etc., evaporated metal layers, ionic polymers such as those described in Minsk, U.S. Pat. Nos. 2,861,056 and 3,206,312 or insoluble inorganic salts such as those described in Trevoy, U.S. Pat. No. 3,428,451.

Photographic emulsions containing the supersensitizing combinations of the invention can be coated on a wide variety of supports. Typical supports include polyester film, subbed polyester film, poly(ethylene terephthalate) film, cellulose nitrate film, cellulose ester film, poly(vinyl acetal) film, polycarbonate film and related or resinous materials, as well as glass, paper, metal and the like. Typically, a flexible support is employed, especially a paper support, which can be partially acetylated or coated with baryta and/or an alpha-olefin polymer, particularly a polymer of an alpha-olefin containing 2 to 10 carbon atoms such as polyethylene, polypropylene, ethylenebutene copolymers and the like.

Supersensitized emulsions of the invention can contain plasticizers and lubricants such as polyalcohols, e.g., glycerin and diols of the type described in Milton, U.S. Pat. No. 2,960,404; fatty acids or esters such as those described in Robins, U.S. Pat. No. 2,588,765 and Duane, U.S. Pat. No. 3,121,060; and silicone resins such as those described in DuPont British Patent 955,061.

The photographic emulsions supersensitized as described herein can contain surfactants such as saponin, anionic compounds such as the alkylarylsulfonates described in Baldsiefen, U.S. Pat. No. 2,600,831 fluorinated surfactants, and amphoteric compounds such as those described in Ben-Ezra, U.S. Pat. No. 3,133,816.

Photographic elements containing emulsion layers sensitized as described herein can contain matting agents such as starch, titanium dioxide, zinc oxide, silica, polymeric beads including beads of the type described in Jelley et al., U.S. Pat. No. 2,992,101 and Lynn, U.S. Pat. No. 2,701,245.

Spectrally sensitized emulsions of the invention can be utilized in photographic elements which contain brightening agents including stilbene, triazine, oxazole and coumarin brightening agents. Water soluble brightening agents can be used such as those described in Albers et al., German Patent 972,067 and McFall et al., U.S. Pat. No. 2,933,390 or dispersions of brighteners can be used such as those described in Jansen, German Patent 1,150,274 and Oetiker et al., U.S. Pat. No. 3,406,070.

Photographic elements containing emulsion layers supersensitized according to the present invention can be used in photographic elements which contain light absorbing materials and filter dyes such as those described in Sawdey, U.S. Pat. No. 3,253,921; Gaspar, U.S. Pat. No. 2,274,782; Carroll et al., U.S. Pat. No. 2,527,583 and Van Campen, U.S. Pat. No. 2,956,879. If desired, the dyes can be mordanted, for example, as described in Milton and Jones, U.S. Pat. No. 3,282,699.

Contrast enhancing additives such as hydrazines, rhodium, iridium and combinations thereof are also useful.

Photographic emulsions of this invention can be coated by various coating procedures including dip coating, air knife coating, curtain coating, or extrusion coating using hoppers of the type described in Beguin, U.S. Pat. No. 2,681,294. If desired, two or more layers may be coated simultaneously by the procedures described in Russell, U.S. Pat. No. 2,761,791 and Wynn British Patent 837,095.

The couplers may be present either directly bound by a hydrophilic colloid or carried in a high temperature boiling organic solvent which is then dispersed within a hydrophilic colloid. The colloid may be partially hardened or fully hardened by any of the variously known photographic hardeners. Such hardeners are free aldehydes (U.S. Pat. No. 3,232,764), aldehyde releasing compounds (U.S. Pat. Nos. 2,870,013 and 3,819,608), s-triazines and diazines (U.S. Pat. Nos. 3,325,287 and 3,992,366), aziridines (U.S. Pat. No. 3,271,175), vinylsulfones (U.S. Pat. No. 3,490,911), carbodiimides, and the like may be used.

The silver halide photographic elements can be used to form dye images therein through the selective formation of dyes. The photographic elements described above for forming silver images can be used to form dye images by employing developers containing dye image formers, such as color couplers, as illustrated by U.K. Patent No. 478,984; Yager et al., U.S. Pat. No. 3,113,864; Vittum et al., U.S. Pat. Nos. 3,002,836, 2,271,238 and 2,362,598. Schwan et al. U.S. Pat. No. 2,950,970; Carroll et al., U.S. Pat. No. 2,592,243; Porter et al., U.S. Pat. Nos. 2,343,703, 2,376,380 and 2,369,489; Spath U.K. Patent No. 886,723 and U.S. Pat. No. 2,899,306; Tuite U.S. Pat. No. 3,152,896 and Mannes et al., U.S. Pat. Nos. 2,115,394, 2,252,718 and 2,108,602, and Pilato U.S. Pat. No. 3,547,650. In this form the developer contains a color-developing agent (e.g., a primary aromatic amine which in its oxidized form is capable of reacting with the coupler (coupling) to form the image dye. Also, instant self-developing diffusion transfer film can be used as well as photothermographic color film or paper using silver halide in catalytic proximity to reducable silver sources and leuco dyes.

The dye-forming couplers can be incorporated in the photographic elements, as illustrated by Schneider et al. *Die Chemie*, Vol. 57, 1944, p. 113, Mannes et al. U.S. Pat. No. 2,304,940, Martinez U.S. Pat. No. 2,269,158, Jelley et al. U.S. Pat. No. 2,322,027, Frolich et al. U.S. Pat. No. 2,376,679, Fierke et al. U.S. Pat. No. 2,801,171, Smith U.S. Pat. No. 3,748,141, Tong U.S. Pat. No. 2,772,163, Thirtle et al. U.S. Pat. No. 2,835,579, Sawdey et al. U.S. Pat. No. 2,533,514, Peterson U.S. Pat. No. 2,353,754, Seidel U.S. Pat. No. 3,409,435 and Chen Research Disclosure, Vol. 159, July 1977, Item 15930. The dye-forming couplers can be incorporated in different amounts to achieve differing photographic effects. For example, U.K. Patent No. 923,045 and Kumai et al. U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are non-diffusible, colorless couplers, such as two and four equivalent couplers of the open chain ketomethylene, pyrazolone, pyrazolone, pyrazolotriazole, pyrazolobenzimidazole, phenol and naphthol type hydrophobically ballasted for incorporation in high-boiling organic (coupler) solvents. Such couplers are illustrated by Salminen et al. U.S. Pat. Nos. 2,423,730, 2,772,162, 2,895,826, 2,710,803, 2,407,207, 3,737,316 and 2,367,531; Loria et al. U.S. Pat. Nos. 2,772,161, 2,600,788, 3,006,759, 3,214,437 and 3,253,924; McCrossen et al., U.S. Pat. No. 2,875,057; Bush et al. U.S. Pat. No. 2,908,573; Gledhill et al. U.S. Pat. No. 3,034,892; Weissberger et al. U.S. Pat. Nos. 2,474,293, 2,407,210, 3,062,653, 3,265,506 and 3,384,657; Porter et al. U.S. Pat. No. 2,343,703; Greenhalgh et al. U.S. Pat. No. 3,127,269; Feniak et al. U.S. Pat. Nos. 2,865,748, 2,933,391 and 2,865,751; Bailey et al. U.S. Pat. No. 3,725,067; Beavers et al. U S. Pat. No. 3,758,308; Lau U.S. Pat. No. 3,779,763; Fernandez U.S. Pat. No. 3,785,829; U.K. Patent No. 969,921; U.K. Patent No. 1,241,069; U.K. Patent No. 1,011,940, Vanden Eynde et al. U.S. Pat. No. 3,762,921; Beavers U.S. Pat. No. 2,983,608; Loria U.S. Pat. Nos. 3,311,476, 3,408,194, 3,458,315, 3,447,928, 3,476,563; Cressman et al. U.S. Pat. No. 3,419,390; Young U.S. Pat. No. 3,419,391; Lestina U.S. Pat. No. 3,519,429; U.K. Patent No. 975,928; U.K. Patent No. 1,111,554; Jaeken U.S. Pat. No. 3,222,176 and Canadian Patent No. 726,651; Schulte et al. U.K. Patent No. 1,248,924 and Whitmore et al. U.S. Pat. No. 3,227,550. Dye-forming couplers of differing reaction rates in single or separate layers can be employed to achieve desired effects for specific photographic applications.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated by Whitmore et al. U.S. Pat. No. 3,148,062; Barr et al. U.S. Pat. No. 3,227,554; Barr U.S. Pat. No. 3,733,201; Sawdey U.S. Pat. No. 3,617,291; Groet et al. U.S. Pat. No. 3,703,375; Abbott et al. U.S. Pat. No. 3,615,506; Weissberger et al. U.S. Pat. No. 3,265,506; Seymour U.S. Pat. No. 3,620,745; Marx et al. U.S. Pat. No. 3,632,345; Mader et al. U.S. Pat. No. 3,869,291; U.K. Patent No. 1,201,110; Oishi et al. U.S. Pat. No. 3,642,485; Verbrugghe, U.K. Patent No. 1,236,767; Fujiwhara et al. U.S. Pat. No. 3,770,436 and Matsuo et al. U.S. Pat. No. 3,808,945. Dye-forming couplers and non-dye-forming compounds which upon coupling release a variety of photographically useful groups are described by Lau U.S. Pat. No. 4,248,962. DIR compounds which do not form dye upon reaction with oxidized color-developing agents can be employed, as illustrated by Fujiwhara et al. German OLS 2,529,350 and U.S. Pat. Nos. 3,928,041, 3,958,993 and 3,961,959; Odenwalder et al. German OLS No. 2,448,063; Tanaka et al. German OLS No. 2,610,546; Kikuchi et al. U.S. Pat. No. 4,049,455 and Credner et al. U.S. Pat. No. 4,052,213. DIR compounds which oxidatively cleave can be employed, as illustrated by Porter et al. U.S. Pat. No. 3,379,529; Green et al. U.S. Pat. No. 3,043,690; Barr U.S. Pat. No. 3,364,022; Duennebier et al. U.S. Pat. No. 3,297,445 and Rees et al. U.S. Pat. No. 3,287,129. Silver halide emulsions which are relatively light insensitive, such as Lipmann emulsions, having been utilized as interlayers and overcoat layers to prevent or control the migration of development inhibitor fragments as described in Shiba et al. U.S. Pat. No. 3,892,572.

The photographic elements can incorporate colored dye-forming couplers, such as those employed to form integral masks for negative color images, as illustrated by Hanson U.S. Pat. No. 2,449,966; Glass et al. U.S. Pat. No. 2,521,908; Gledhill et al. U.S. Pat. No. 3,034,892; Loria U.S. Pat. No. 3,476,563; Lestina U.S. Pat. No. 3,519,429; Friedman U.S. Pat. No. 2,543,691; Puschel et al. U.S. Pat. No. 3,028,238; Menzel et al. U.S. Pat. No. 3,061,432 and Greenhalgh U.K. Patent No. 1,035,959, and/or competing couplers, as illustrated by Murin et al. U.S. Pat. No. 3,876,428; Sakamoto et al. U.S. Pat. No. 3,580,722; Puschel U.S. Pat. No. 2,998,314; Whitmore U.S. Pat. No. 2,808,329; Salminen U.S. Pat. No. 2,742,832 and Weller et al. U.S. Pat. No. 2,689,793.

The photographic elements can include image dye stabilizers. Such image dye stabilizers are illustrated by U.K. Patent No. 1,326,889; Lestina et al. U.S. Pat. Nos. 3,432,300 and 3,698,909; Stern et al. U.S. Pat. No. 3,574,627; Brannock et al. U.S. Pat. No. 3,573,050; Arai et al. U.S. Pat. No. 3,764,337 and Smith et al. U.S. Pat. No. 4,042,394.

The color provided in the image produced by exposure of the differently sensitized silver halide emulsion layers does not have to be produced by color coupler reaction with oxidized color developers. A number of other color image forming mechanisms well known in the art can also be used. Amongst the commercially available color image forming mechanisms are the diffusion transfer of dyes, dye-bleaching, and leuco dye oxidation. Each of these procedures is used in commercial products, is well understood by the ordinarily skilled photographic artisan, and is used with silver halide emulsions. Multicolor elements using these different technologies are also commercially available. Converting the existing commercially available systems to the practice of the present invention could be done by routine redesign of the sensitometric parameters of the system according to the teachings of the present invention. For example, in a conventional instant color, dye transfer diffusion element, the sensitivity of the various layers and/or the arrangement of filters between the silver halide emulsion layers would be directed by the teachings of the present invention, the element otherwise remaining the same.

These types of imaging systems are well known in the art. Detailed discussions of various dye transfer, diffusion processes may be found for example in "A Fundamentally New Imaging Technology for Instant Photography", W. T. Harison, Jr., Photographic Science and Engineering, Vol. 20, No. 4, July/Aug. 1976, and Neblette's Handbook of Photography and Reprography, Materials, Processes and Systems, 7th Edition, John M. Stunge, van Nostrand Reinhold Company, N.Y., 1977, pp. 324–330 and 126. Detailed discussion of dye-bleach color imaging systems are found for example in *The Reproduction of Colour*, 3rd Ed., R. W. G. Hunt, Fountain Press, London, England 1975 pp. 325–330; and *The Theory of the Photographic Process*, 4th Ed., Mees and James, Macmillan Publishing Co., Inc., N.Y., 1977 pp. 363–366. Pages 366–372 of Mees and James, supra. also discuss dye-transfer processes in great detail. Leuco dye oxidation in silver halide systems are disclosed in such literature as U.S. Pat. Nos. 4,460,681, 4,374,821 and 4,021,240.

Other conventional photographic addenda such as coating aids, antistatic agents, acutance dyes, antihalation dyes and layers, antifoggants, latent image stabilizers, antikinking agents, and the like may also be present.

Although not essential in the practice of the present invention, one particularly important class of additives which finds particular advantage in the practice of the present invention is high intensity reciprocity failure (HIRF) reducers. Amongst the many types of stabilizers for this purpose are chloropalladites and chloroplatinates (U.S. Pat. No. 2,566,263), iridium and/or rhodium salts (U.S. Pat. Nos. 2,566,263; 3,901,713), cyanorhodates (Beck et al., J. Signalaufzeichnungsmaterialen, 1976, 4, 131), cyanoiridates.

EXAMPLES

In the following examples, a gelatin, chemically sulfur-sensitized silver chlorobromide emulsion was prepared to provide an emulsion with 88% bromide and 12% chloride with an average grain size of 1 micron. A yellow colorforming coupler A (prepared by standard methods described in U.S. Pat. No. 4,363,873) was added to the emulsion. The sensitizing dyes were added as 0.05% by weight solutions in methanol. Phenylmercaptotetrazole (V-A) or other substituted mercaptotetrazole compounds were added as 0.1% methane solutions, and the amine-type acetic acid compounds as 10% methanol or aqueous solutions. The silver and coupler coating weights were 500 mg per $m^2$ and 748 mg per $m^2$, respectively.

A protective gelatin topcoat containing a hardener and surfactant was coated so that the gelatin coating weight was 1.03 g/$m^2$.

The two layer construction was coated on a resin-coated paper base. In addition to this construction, other emulsions having sensitivity in other spectral regions may be further coated to form multilayered light-sensitive photographic materials. In all examples where a mercaptotetrazole was used, unless otherwise indicated (as in Example 18), 0.59 grams of the mercaptotetrazole was used per kilogram of silver.

EXAMPLES 1–5

The construction described above was exposed with light from a 2950 K tungsten lamp giving 2400 meter candles (mc) illuminance at the filter plane for 0.1 seconds through a 20 cm continuous type m carbon wedge (gradient 0.20 density/cm) and a red selective Wratten filter. After exposure, the samples were processed in standard EP-2 processing color chemistry with conditions similar to those stated in U.S. Pat. No. 4,363,873. After processing, Status D densitometry was measured. The $D_{min}$, $D_{max}$, speed and average contrast were measured and are shown in Table 1. The speed was measured at an absolute density of 0.75 and the slope of the line joining the density points of 0.50 and 1.30 above base plus fog was used as a measure of the average contrast.

EXAMPLES 6–8

In the following examples the samples were exposed with the light from a 2mW 780 laser diode. The light beam was aimed through a circular wedge neutral-density filter (0–4 neutral density) and then reflected to strike a rotating polygon mirror. The beam was deflected to strike the sample which was wrapped around a drum. The wedge filter was mechanically tied to this drum around which the film sample was attached. As the wedge filter rotated so did the sample to imitate a 0.2 density exposure per cm along the sample strip. The sample was exposed in a laser raster-scan fashion. The spot velocity was 300 m/sec with an interline time of 1.67 milliseconds. The material once exposed was processed and analyzed as described for tungsten exposures.

EXAMPLES 9–11

In the following examples, the samples were exposed with light from a 2mW 820 nm laser diode. The conditions of exposure, processing and densitometry are described in Examples 5–8.

EXAMPLES 12–13

In the following examples, the samples were exposed with light from a 2mW 880 nm laser diode. The conditions of exposure, processing and densitometry are described in Examples 6–8.

In all examples 1–13 the amine-type acetic acid IV-A was a 10% aqueous solution containing 3% by weight KOH.

The results show that in some cases the compound IV-A alone is a supersensitizer. However, the most efficient supersensitizing effect is observed when IV-A is used with V-A (phenylmercaptotetrazole).

EXAMPLES 14–17

In the following examples the samples were exposed, processed and analyzed in the same manner as described in Examples 9–11.

The results show the supersensitizing effect of different types of the amine acetic acid compounds. Also an increase in contrast is also observed with these compounds and in conjunction with phenylmercaptotetrazole.

EXAMPLE 18

In the following example the sample was exposed, processed and analyzed in the same manner as described in Examples 9–11.

The results show the supersensitizing effect and an increase in contrast for the combination of compounds IV-A with V-E and sensitizing dye VI-A.

Coupler A

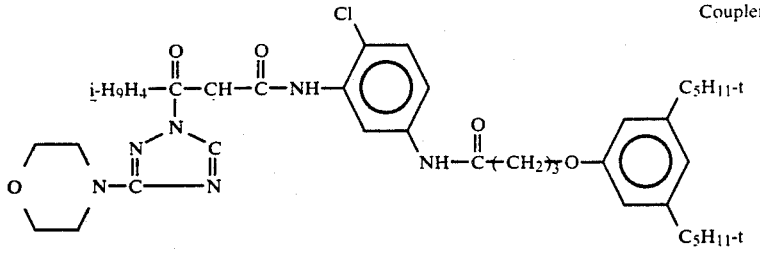

TABLE 1

| Ex. No. | Sensitizing Dye and Amount Used ($2.3 \times 10^{-4}$ mol/mol Ag) | Amine Amount Used (g/kg Ag) | Mercapto-tetrazole 0.59 g/Kg Ag | Dmin | Dmax | Speed | Contrast |
|---|---|---|---|---|---|---|---|
| 1 | VIII-6 | — | — | .10 | 2.51 | 1.93 | 3.61 |
| | " | — | V-A | .01 | .21 | .36 | −.16 |
| | " | IV-A 118 | — | .00 | .22 | .49 | .19 |
| | " | IV-A 118 | V-A | .01 | .19 | .83 | −.14 |
| 2 | VIII-a | — | — | .09 | 2.78 | 2.63 | 4.00 |
| | " | — | V-A | .02 | −.02 | 0.54 | −.45 |
| | " | IV-A 118 | — | .01 | .00 | 0.29 | .18 |
| | " | IV-A 118 | V-A | .02 | .01 | 0.92 | −.39 |
| 3 | VIII-B | — | — | .09 | 2.69 | 3.94 | 4.32 |
| | " | — | V-A | .01 | .12 | .11 | −.40 |
| | " | IV-A 118 | — | .01 | .07 | .38 | .11 |
| | " | IV-A 118 | V-A | .01 | .10 | .24 | −.04 |
| 4 | VIII-E | — | — | .12 | 1.06 | 1.34 | * |
| | " | — | V-A | .03 | 1.76 | .77 | 3.39 |
| | " | IV-A 118 | — | .01 | .08 | .02 | * |
| | " | IV-A 118 | V-A | .02 | 1.73 | .96 | 3.36 |
| 5 | VIII-C | — | — | .10 | .80 | 1.36 | * |
| | " | — | V-A | .02 | 1.99 | 1.97 | 3.35 |
| | " | IV-A 118 | | .00 | .10 | .05 | * |
| | " | IV-A 118 | V-A | .02 | 2.00 | 2.14 | 3.40 |
| 6 | V-D | — | — | .16 | 2.48 | 2.41 | 2.32 |
| | " | — | V-A | .01 | .14 | .39 | .05 |
| | " | IV-A 118 | — | .01 | .13 | −.14 | −.45 |
| | " | IV-A 118 | V-A | .04 | .13 | .64 | .05 |
| 7 | VIII-F | — | — | .10 | .13 | * | * |
| | " | — | V-A | .00 | 1.07 | 1.56 | 3.00 |
| | " | IV-A 118 | — | .00 | .01 | * | * |
| | " | IV-A 118 | V-A | .01 | 2.20 | 2.02 | 2.93 |
| 8 | VIII-I | — | — | .08 | 1.73 | 1.64 | 3.97 |
| | " | — | V-A | .00 | .81 | .62 | .22 |
| | " | IV-A 118 | — | .01 | .11 | .08 | .07 |
| | " | IV-A 118 | V-A | .02 | .87 | 1.07 | .53 |
| 9 | VI-B | — | — | .18 | 1.60 | 1.90 | 2.72 |
| | " | — | V-A | −.01 | .63 | .33 | −.78 |
| | " | IV-A 118 | — | .02 | .79 | .35 | −.38 |
| | " | IV-A 118 | V-A | .07 | .98 | .84 | −.25 |
| 10 | VI-A | — | — | .11 | 2.52 | 2.31 | 2.77 |
| | " | — | V-A | .02 | .13 | .72 | .64 |
| | " | IV-A 118 | — | .02 | .04 | .22 | .35 |
| | " | IV-A 118 | V-A | .03 | .14 | 1.01 | .69 |
| 11 | VIII-D | — | — | .09 | .12 | * | * |
| | " | — | V-A | .02 | .60 | 1.51 | * |
| | " | IV-A 118 | — | .00 | * | * | * |
| | " | IV-A 118 | V-A | .02 | 1.61 | 1.90 | 3.36 |
| 12 | VII-A | — | — | .13 | 1.16 | 1.71 | * |
| | " | — | V-A | .00 | 1.50 | 1.57 | 3.39 |
| | " | IV-A 118 | — | .00 | .18 | .06 | * |
| | " | IV-A 118 | V-A | .02 | 1.50 | 1.75 | 3.31 |
| 13 | VII-B | — | — | .11 | .93 | 1.60 | * |
| | " | — | V-A | .01 | .14 | .10 | * |
| | " | IV-A 118 | — | .02 | .00 | .00 | * |
| | " | IV-A 118 | V-A | .01 | 1.25 | .59 | 2.37 |
| 14 | VI-A | — | — | .13 | 2.50 | 2.22 | 2.65 |
| | " | — | V-A | .00 | .32 | .61 | .45 |
| | " | III-A 118 | — | .00 | .13 | .05 | .18 |
| | " | III-A 118 | V-A | .00 | .32 | .80 | .88 |
| 15 | VI-A | — | — | .13 | 2.47 | 2.21 | 2.65 |
| | " | — | V-A | −.01 | .27 | .61 | .43 |
| | " | III-B 115 | — | −.02 | .20 | .30 | .67 |
| | " | III-B 115 | V-A | −.01 | .27 | .91 | .84 |
| 16 | VI-A | — | — | .12 | 1.77 | 1.82 | 2.14 |
| | " | — | V-A | .00 | .98 | .68 | .27 |
| | " | I-A 83 | — | −.01 | .40 | .12 | −.30 |

TABLE 1-continued

| Ex. No. | Sensitizing Dye and Amount Used ($2.3 \times 10^{-4}$ mol/mol Ag) | Amine Amount Used (g/kg Ag) | Mercapto-tetrazole 0.59 g/Kg Ag | Dmin | Dmax | Speed | Contrast |
|---|---|---|---|---|---|---|---|
| | " | I-A 83 | V-A | −.01 | 1.04 | .84 | .23 |
| 17 | VI-A | — | — | .12 | 1.80 | 1.82 | 2.11 |
| | " | — | V-A | .00 | .87 | .66 | .25 |
| | " | I-B 78 | — | −.01 | .57 | .19 | −.03 |
| | " | I-B 78 | V-A | −.02 | .96 | .91 | .29 |
| 18 | VI-A | — | — | .13 | 1.37 | 1.69 | * |
| | " | — | V-E | .01 | 1.09 | .45 | 2.28 |
| | " | IV-A 59 | — | .00 | .83 | .30 | 2.43 |
| | " | IV-A 59 | V-E | .00 | 1.33 | .92 | 2.86 |

In the above Table 1, all underlined values are for the unmodified emulsion which contains only the sensitizing dye indicated, but no amine or mercaptotetrazole. The values listed under the underlined values for Dmin, Dmax, Speed and Contrast indicate changes in those parameters. All values are positive changes unless otherwise indicated. An asterisk (*) indicates that the value of that particular parameter was not measurable. In these examples, the mercaptotetrazole was used in an amount of 0.59 g/KgAg except in Example 18 where 0.30 g/KgAg was used.

It is to be noted that the supersensitizing compounds of the present invention are present in the unexposed (no developable latent image) photographic emulsion. Some of the described complexing agents are present in developer solutions and thus would be in immersion contact with an exposed photographic emulsion during development. This is quite different from the practice of the present invention.

What is claimed is:

1. A chemically sensitized and spectrally sensitized silver halide emulsion having no latent image therein having an effective amount of a metal complexing agent wherein said complexing agent is an amine-type acetic compound, ester compounds thereof, or alkali metal salt thereof wherein said amine-type acetic acid compounds are present in a range between 2 and 35% by weight of silver in said emulsion and are represented by any of the formulae:

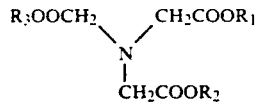
I

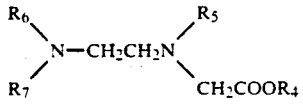
II

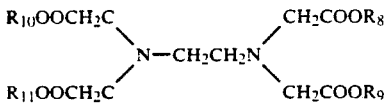
III

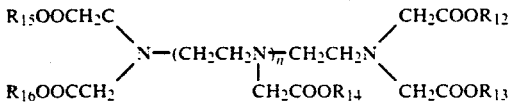
IV wherein $R_1$ through $R_4$, $R_8$ through $R_{16}$, which can be the same or different, each represents a hydrogen atom, an alkali metal atom, aryl group, or an alkyl group, and $R_5$–$R_7$, which can be the same or different, each represents a hydrogen atom, an alkyl group or an acetic acid group as shown below $$-CH_2COOR_1$$

wherein $R_1$ is defined above, and n represents an integer of 1 or greater.

2. The emulsion of claim 1 wherein said metal complexing agent was added after chemical sensitization.

3. A chemically sensitized and spectrally sensitized silver halide emulsion having no latent image therein having from 3–32% by weight of a metal complexing agent per unit weight of silver in said emulsion.

4. The emulsion of claim 3 wherein said complexing agent is selected from the group consisting of amine-type acetic acid compounds, esters of amine-type acetic acid compounds, and alkali metal salts of amine-type acetic acid compounds.

5. The emulsion of claim 4 wherein said amine-type acetic acid compounds are represented by any of the formulae:

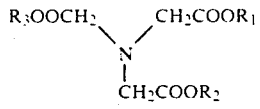
I

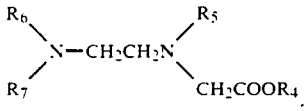
II

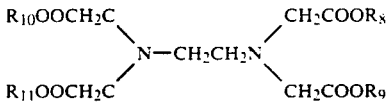
III

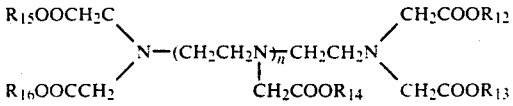
IV wherein $R_1$ through $R_4$, and $R_8$ through $R_{16}$, which can be the same or different, each represents a hydrogen atom, an alkali metal atom, aryl group, or an alkyl group, and $R_5$–$R_7$, which can be the same or different, each represents a hydrogen atom, an alkyl group or an acetic acid group as shown below $$-CH_2COOR_1$$

wherein $R_1$ is as defined above, and n represents an integer of 1 or greater.

6. The emulsion of claim 5 wherein $R_1$, $R_2$, $R_3$, $R_4$, $R_8$, $R_9$, $R_{10}$, $R_{11}$, $R_{12}$, $R_{13}$, $R_{14}$, $R_{15}$, and $R_{16}$ are alkyl groups.

7. The emulsion of claim 4 wherein said complexing agent is present in a range of from 5–20%.

8. The emulsion of claim 5 wherein said complexing agent is present in a range of from 5–20%.

9. A chemically sensitized and spectrally sensitized silver halide emulsion having no latent image therein and having an effective amount of a metal complexing agent therein in an amount equal to at least 1% by weight of silver in said emulsion said emulsion further comprising an effective amount of a substituted mercaptotetrazole of the formula:

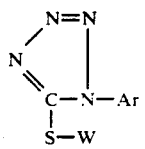

wherein Ar is a phenyl group, either substituted or not substituted, and W is hydrogen or a second substituted mercaptotetrazole bonded at the sulfur atom thereof and having a phenyl group, substituted or not substituted, on a nitrogent adjacent to the carbon atom in the tetrazole nucleus.

10. The emulsion of claim 9 wherein said complexing agent is an amine-type acetic acid compound, ester compounds thereof, or alkali metal salt thereof.

11. The emulsion of claim 9 wherein said amine-type acetic acid compounds are present in a range between 2 and 35% by weight of silver in said emulsion and are represented by any of the formulae:

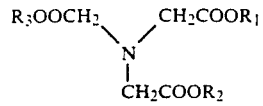

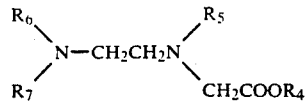

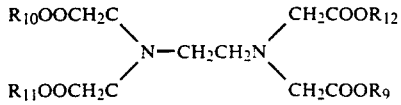

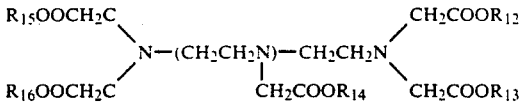

wherein $R_1$ through $R_4$, $R_8$ through $R_{16}$, which can be the same or different, each represents a hydrogen atom, an alkali metal atom, aryl group, or an alkyl group, and $R_5$–$R_7$, which can be the same or different, each represents a hydrogen atom, an alkyl group or an acetic acid group as shown below $$-CH_2COOR_1$$

wherein $R_1$ is defined above, and n represents an integer of 1 or greater.

12. The emulsion of claim 9 wherein said metal complexing agent was added after chemical sensitization.

13. The emulsion of claim 10 wherein said metal complexing agent was added after chemical sensitization.

14. The emulsion of claim 11 wherein said metal complexing agent was added after chemical sensitization.

15. The emulsion of claim 9 wherein said silver halide emulsion contains effective amounts of both spectral sensitizing dyes and color couplers.

* * * * *

UNITED STATES PATENT AND TRADEMARK OFFICE

CERTIFICATE OF CORRECTION

PATENT NO. : 5,013,622

DATED : May 7, 1991

INVENTOR(S) : Sharon M. Simpson and John R. Boon

It is certified that error appears in the above-identified patent and that said Letters Patent is hereby corrected as shown below:

Columns 7-8, Formula VIIIG, "$H_5C_2$-$N^-$" should read --$H_5C_2$-$N^+$--.

Column 11, line 34, "substitutes" should read --substituted--.

Signed and Sealed this

Seventh Day of December, 1993

*Attest:*

*Attesting Officer*

Bruce Lehman

BRUCE LEHMAN

*Commissioner of Patents and Trademarks*